United States Patent [19]

de Brabant

[11] 4,429,501

[45] Feb. 7, 1984

[54] ATRIUM BUILDING STRUCTURE

[76] Inventor: Jean Y. de Brabant, 8 Chelsea Pl., Montreal, Quebec, Canada, H3G 2J9

[21] Appl. No.: 398,002

[22] Filed: Jul. 14, 1982

Related U.S. Application Data

[63] Continuation-in-part of Ser. No. 380,879, May 21, 1982.

[30] Foreign Application Priority Data

Jul. 23, 1981 [CA] Canada ..... 382360

[51] Int. Cl.[3] ..... E04H 1/00

[52] U.S. Cl. ..... 52/236.2; D25/31

[58] Field of Search ..... 52/236.1, 236.2, 236.3, 52/202; 126/417; D25/31, 32, 5

[56] References Cited

U.S. PATENT DOCUMENTS

| | | | |
|---|---|---|---|
| D. 208,090 | 7/1967 | Tesch | D25/5 |
| D. 216,424 | 1/1970 | Estes | D25/5 |
| D. 222,343 | 10/1971 | Mullen | D25/5 |
| D. 230,724 | 3/1974 | Infante | D25/4 |
| D. 243,955 | 4/1977 | Kosinski | D25/5 |
| 1,512,975 | 10/1924 | Bright . | |
| 1,991,695 | 12/1928 | Petrovitch | 98/29 |
| 2,154,897 | 4/1939 | Grant . | |
| 2,156,859 | 5/1939 | Lowe | 189/5 |
| 3,337,999 | 3/1965 | Prus | 52/2 |
| 3,535,835 | 8/1967 | Kupper | 52/79.2 |
| 3,754,364 | 8/1973 | Ice | 52/187 |
| 4,136,492 | 1/1979 | Willingham | 52/79.7 |
| 4,156,994 | 6/1979 | Steuer et al. | 424/70 |

FOREIGN PATENT DOCUMENTS

| | | |
|---|---|---|
| 295652 | 12/1929 | Canada . |
| 674693 | 11/1963 | Canada . |
| 41143 | of 0000 | France . |
| 679826 | of 0000 | France . |
| 381846 | of 0000 | Switzerland . |

OTHER PUBLICATIONS

Progressive Architecture, Apr. 1980, p. 133.
Progressive Architecture, Aug. 1978, p. 71.
Progressive Architecture, Nov. 1980, p. 95.
Progressive Architecture, Jan. 1981, p. 138.

*Primary Examiner*—John E. Murtagh
*Assistant Examiner*—Kathryn L. Ford
*Attorney, Agent, or Firm*—Bradford E. Kile

[57] ABSTRACT

A building structure is disclosed which comprises a central core with a plurality of habitable areas extending radially outwardly therefrom in the manner of spokes of a wheel. Glassed-in walls extend between the spokes to provide a plurality of climate-controlled atria. Facades on the sides of the spokes adjoining the atria also have glassed-in walls providing a view of both the atria and the outdoors from within the habitable areas. The horizontal section of the building may be circular, oblong or polygonal.

4 Claims, 6 Drawing Figures

ATRIUM BUILDING STRUCTURE

This application is a continuation-in-part of my previous application Ser. No. 06/380,879 filed May 21, 1982 and entitled atrium "BUILDING STRUCTURE".

This invention relates to building structures; more particularly it relates to an enclosed building, the perimeter of which would normally be in glass and the interior of which contains built useable spaces as well as a number of atria.

The horizontal section of the building comprises a central core with useable or habitable areas extending radially outwards from the central core in the manner of spokes of a wheel. The number of spokes may vary according to the particular use of the building and the details of the design.

The overall concept of the building is that of a multistory glassed-in tower which may be cylindrical in form. However, not all the spokes need be of the same length. Thus, the horizontal section may be oval or oblong, for example, rather than circular. Moreover, the exterior walls joining the outer ends of successive spokes may be planar rather than arcuate causing the horizontal section to be polygonal. Other modifications are possible in wich some exterior walls are arcuate and other planar.

The atria are formed by the spaces between the facades of the useable spaces within the spokes and the perimeter walls joining the outer ends of successive spokes.

It is an important feature of the invention that there is provided an enclosed building having useable or habitable space, such as offices, hotel rooms or condominiums enclosed within the radially extending spokes with a maximum visible exposure both to the environmentally controlled atria and also to the outdoors through the exterior glass walls of the atria.

Ideally, the full expanse of one of the atria should be visible from each of the rooms or enclosed areas in the spokes through the glassed-in walls of the facades. There should also be a relatively wide-angled view of the outdoors from within any given habitable room through the glass perimeter wall of the associated atrium. It is a general objective of the invention that the habitable area will have such views of the atria and outdoors.

The ratio of the length of the peripheral wall of an atrium to the total length of the facades adjoining is obviously closely related to the angle between the two facades of a particular atrium and to the number of spokes.

It is important, especially when the habitable area is used for dwelling accommodation, such as apartments or condominiums, that the visual exposure of each dwelling unit as seen from the other units facing on the same atrium be kept to a minimum for the sake of privacy. In order to do this the portion of each dwelling unit facing on the atrium should be oblique to the corresponding portion of all the other units. Clearly this requires that the number of spokes be small, preferably three.

It is desirable to have a balcony or veranda on the side of each habitable unit. This allows full advantage to be taken of the view of the atrium and the outdoors. Also, when partitions are provided between adjoining balconies privacy is further enhanced.

There are already known various building structures which have one or more atria adjoining exterior walls thereof. Any such structures which are known to the applicant provide a view of the atria only from a very limited portion of the habitable area of the building let alone of the outdoor space beyond. In determination of the merits of the present invention it is of prime importance to note the advantages which accrue from the geometric configuration and topology of the structure employed. In relation to this particular aspect of the invention the elements with which it deals are:

1. The geometry of the habitable space;
2. The geometry of the exterior envelope; and
3. The total projection of the building in relation to the ground.

The synergistic effect of applying the spoked wheel-atrium concept to the three aforesaid elements is to produce the maximum possible simultaneous exposure of the facades of the habitable space to space within the atria and to the outdoors. This very advantageous effect is produced whether the exterior envelope of the building takes a cylindrical, an oblong or a polygonal form.

There are also known a number of prior art building structures having a plurality of radially extending or elongated habitable units emanating from a central core or unit. Examples of such prior art structure are found in U.S. Pat. No. 2,154,897 issued Apr. 18, 1939 to Henry M. Grant and in U.S. Pat. No. Des. 216,424 issued Jan. 6, 1970 to Moreay P. Estes and Joseph Kott. Such structures, while they do provide an improvement in viewing access to the outdoors, are by no means comparable to the structure of the present invention since they do not have enclosed atria located between the radially extending wings.

Multi-level habitable buildings of polygonal or cylindrical form with radially extending divisions which may extend from a central core are also known. Examples of such buildings are found in U.S. Pat. No. 4,136,492 issued Jan. 30, 1979 to John H. Willingham and U.S. Pat. No. Des. 208,090 issued July 18, 1967 to George D. Tesch. Such buildings, however, fail entirely to accomplish the purpose of the instant invention since they neither have atria which are visible from the majority of habitable units nor do they possess a view of the outdoors from the various portions of the habitable area as does the structure of the instant invention.

It is axiomatic that most heat exchange in a building takes place at the periphery thereof. Such buildings as those described in U.S. Pat. No. 2,154,897 and U.S. Pat. No. Des. 216,424 clearly have a very large external surface area in proportion to that enclosed, and hence are quite energy-inefficient. The periphery of the building structure of the instant invention is normally either equal to or less than $\pi$ times the diameter. Were the perimeter glass shield which encloses the atria removed the length of the facades which would be exposed to the exterior would be greatly increased; typically, the external surface of the building then would be increased by 2 to 3 times.

An energy study has been carried out to determine the air conditioning and heating requirements of building structures of the present invention having 4 and 5 spokes with the requirements of a conventional rectangular building of modern design. The results of this study are very favorable in that the energy expenditure is similar to that of a conventional building of the same habitable area. An average additional expenditure of approximately 12% would be necessary for the atria whereas the volume of the atria is much greater than 12% as compared with the habitable area. Thus in addition to the extraordinary climate offered by the atria is the fact that the structure is very energy-efficient.

On sunny days a large proportion of the energy needed to heat the portions of buildings not exposed to the sun can come from the sun heating the favored atria. The energy may be recuperated in water to permit easy transfer to the opposite side of the building.

In order to minimize energy losses from the atria during the night and in sunless periods it is desirable to increase the thermal resistance of the atrium walls.

It is a general object of the invention to provide a building structure with a plurality of habitable units having enhanced viewing exposure to areas outside the habitable units.

It is another object of the invention to provide a building structure with a plurality of habitable units each of which is viewed obliquely from others of the units to which it is visible.

It is a further object of the invention to provide a building structure which includes a habitable area and a plurality of enclosed atria and which structure has a geometric configuration such as to provide optimum viewing exposure of both the atria and space external to the building from within the habitable area.

It is a further object of the invention to provide a building structure which is energy-efficient at least to the extent that the ratio of external surface area to enclosed space is relatively small.

In accordance with the broader aspect of the invention there is provided a unique building structure with habitable space which in horizontal section comprises a central core and a plurality of spokes extending radially outwardly from said central core, a plurality of successive ones of said spokes being connected by associated peripheral walls to form a plurality of enclosed atria each disposed between an associated pair of spokes, and said atria being circumferentially disposed around said central core.

There is also provided in accordance with a further aspect of the invention a building structure with habitable space which in horizontal section comprises a central area and a plurality of radially-extending spokes surrounding said central area;

each of said spokes having an outer end wall and a pair of side walls extending in a generally radial direction, each of said side walls having at least one transparent portion;

the inner ends of two side walls of each successive pair of spokes being joined to form in horizontal section a shallow U;

a transparent circumferential wall extending between the ends of each pair of joined side walls;

the walls of the shallow U's being so constructed and oriented in relation to one another as to provide from within the habitable space, through any one of the transparent portions of the side walls, a view of substantially the whole area of the adjoining atrium and a broad view of the outdoors through the transparent circumferential wall while providing only an oblique view of other portions of the same U thereby substantially minimizing the visual exposure thereof.

In addition to the aforementioned functional and other practical advantages of the building structure of the invention deriving from the combination of spoke-wheel habitable area and enclosed atria is the fact that the design has considerable aesthetic merit. Not only does it provide a pleasing view from within the habitable area in the spokes but it also has an attractive external appearance.

Other objects, advantages and features of the invention will become apparent from the following description of exemplary embodiments thereof taken in conjunction with the accompanying drawings, in which.

Figure 1:
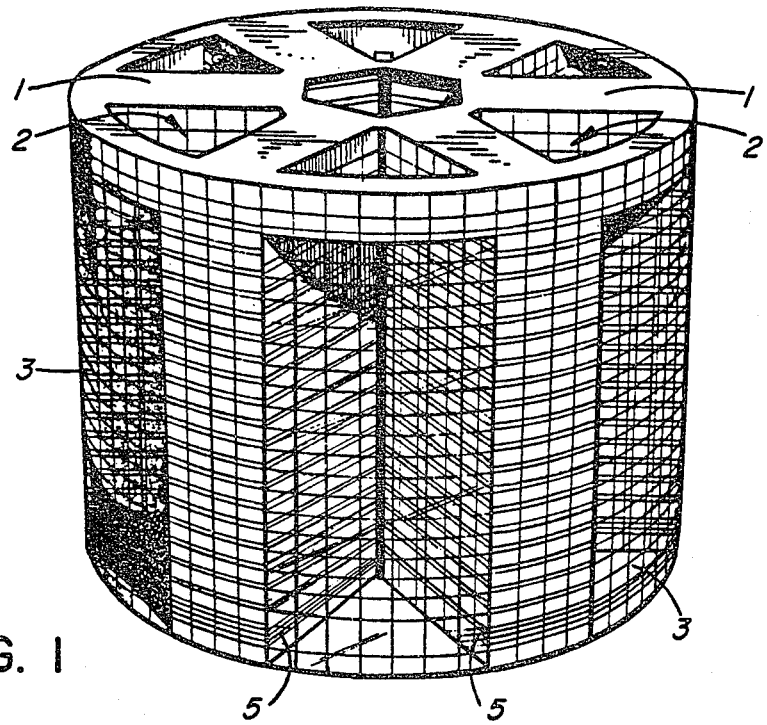
FIG. 1 is a perspective view of an embodiment of the invention with portions of the roof omitted to better illustrate the internal structure.

The embodiment illustrated in FIG. 1 contains 6 spokes or wings 1 extending radially from a central area and having located between each successive pair of spokes an atrium 2 enclosed by a glassed-in wall 3. The spokes as shown in FIG. 1 are all of the same length and the exterior walls of the atria comprise circular arcs providing an overall cylindrical outline. The central area in accordance with FIG. 1 contains an additional atrium. However, it will be understood that this is not an essential feature of the invention. As will be explained in the following, the central area may be utilized for various other purposes.

It will also be understood that while the atria, including the central one, which are shown in FIG. 1 as being open at the top, are in actual practice covered by a roof which may advantageously take the form of a skylight.

Each atrium has a horizontal section in the form of a sector of a circle bounded on the sides by facades 5 of the associated spokes. The walls of the facades normally are of glassed-in construction to provide an optimum view from the habitable area within the spokes of the adjoining atrium and also of the outdoors through the transparent peripheral wall of the atrium.

Figure 2:
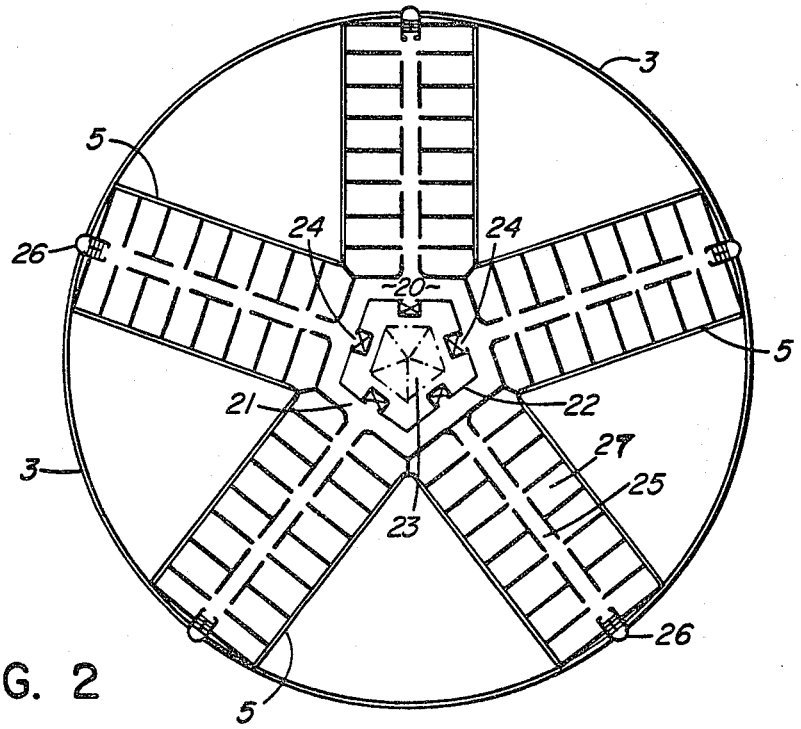
FIG. 2 is a plan view of an embodiment of the invention having a cylindrical shape.

FIG. 2 shows a horizontal section of an embodiment of the invention which is very similar to that of FIG. 1 except that it contains five spokes rather than six. Each of the walls 3 and 5 bordering an atrium are of glass.

Within and around the circumference of the pentagonal central area 20 in FIG. 2 is a continuous passageway 21 which provides access in turn to each of the areas within the spokes. The area enclosed by passageway 21 consists mainly of a pentagonal atrium 22 covered by a skylight 23. Also, located within the atrium 22 are elevator shafts 24 with access from passageway 21.

Each of the spokes contains a central longitudinal passageway 25 extending from passageway 21 to the outer end of the spoke where a stairway 26 is located.

On either side of passageway 21 are rooms 27, each having one end wall forming a portion of a facade.

Figure 3:
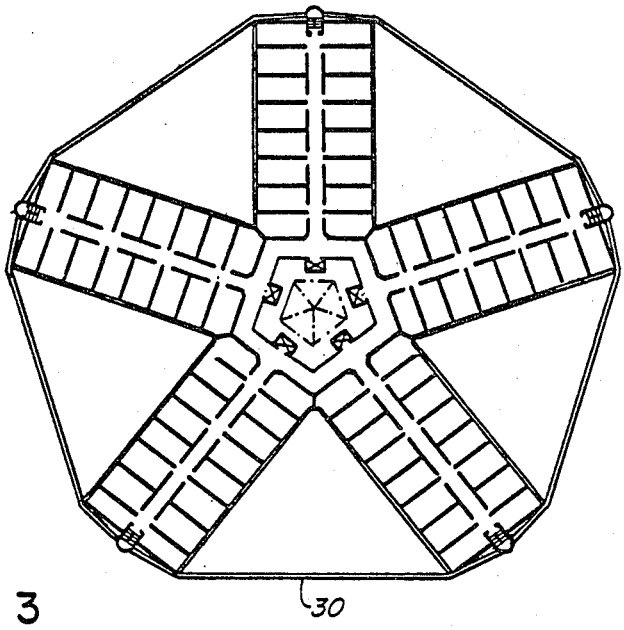
FIG. 3 is a plan view of an embodiment of the invention having spokes of equal length, the outer peripheral walls of the atria being planar.

FIG. 3 shows a horizontal section of an embodiment which differs from that of FIG. 2 only in that the peripheral walls 30 of the atria are planar giving the horizontal section of the building a generally polygonal shape.

Figure 4:
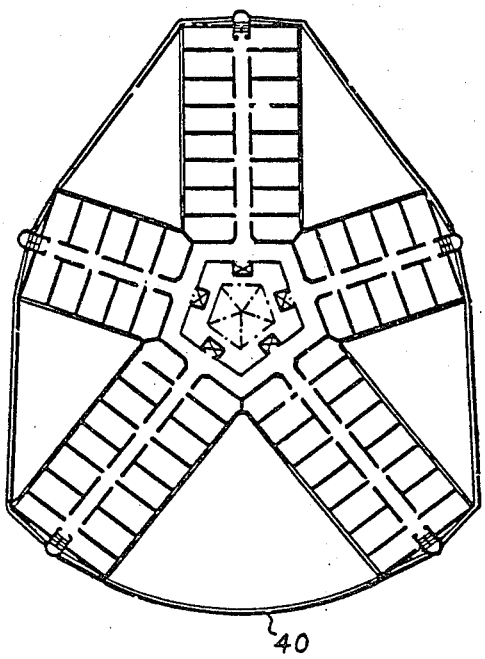
FIG. 4 is a plan view of an embodiment of the invention having an oblong configuration in horizontal section.

FIG. 4 is an example of a variant of the building structure of the invention in which the spokes are of different lengths causing the horizontal section as illustrated to have an oblong shape. Here it will be noted that the peripheral wall 40 of one atrium is arcuate whereas the other peripheral walls of the other atria are planar.

Figure 5:
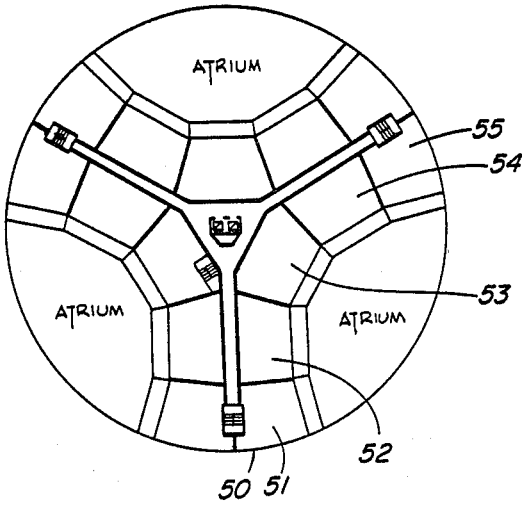
FIG. 5 is a plan view of a further embodiment of the invention.
Figure 6:
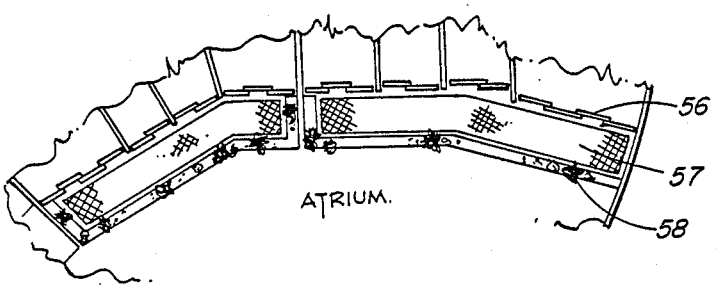
FIG. 6 is a plan view of a portion of the embodiment of FIG. 5 showing portions of a habitable unit bordering on an atrium.

The embodiment illustrated in FIGS. 5 and 6 is an open concept containing three spokes which provides a broad view of one of the atria as well as of the outdoors from each of the habitable units. This embodiment is particularly adapted for living accommodation such as apartments or condominiums but may also be used for offices or hotels.

Surrounding the central area as shown in FIG. 5 are three radially-extending spokes 50 which surround the central area. The spokes contain a plurality of separate habitable units 51, 52, 53, 54, and 55 arranged in such a way that each of the five habitable units face onto one of the three atria. The sides of each two circumferentially successive spokes which extend generally in a radial direction join a unit 53. Thus these sides form a series of facades stretching around the inner side of each atrium in the shape of a shallow U in horizontal section. Where the facade of each unit is planar the shallow U then takes the form of a segment of the circumference of a polygon.

The arrangement of FIG. 5, besides providing a broad view of the adjoining atrium and of the outdoors is particularly advantageous in enhancing privacy among the units which look out on a given atrium. This is so because of the very small difference in angular direction between the facades of successive units facing the atrium. Thus only a very oblique view of the facade of any unit is seen from other units of the group facing on the same atrium.

FIG. 6 shows a portion of the five habitable units fronting on an atrium. The facades are seen to include balconies 57 from which the view of the atrium and the outdoors may be more fully enjoyed. Sliding glass doors 56 provide access to each balcony. A screening partial wall 58, which may include plants or flowers on the side of the balcony facing the atrium together with opaque partitions at the ends of the balcony further enhance privacy.

Although some of the disclosed embodiments include an atrium in the central area such an atrium is not an essential feature of the invention. In most cases it will be desirable to utilize the central area for services such as elevators and/or for heating and air-conditioning equipment.

It is desirable to provide a means to circulate air between the atria and other portions of the building structure. This is advantageous since the atria may be expected to receive heat from sunlight and hence such circulation of air will be beneficial in helping to heat the habitable area. Alternatively, as previously noted, it may be found to be advantageous to transfer energy from one portion of the structure to another by the circulation of water.

It will be understood that the described embodiments are exemplary only. Many other variations of the structure are possible. For example, it is not essential that the facades of a particular spoke be parallel to one another. The invention includes all such variations as would occur to one skilled in the art and is delineated not by the preceding examples but solely by the appended claims.

The embodiments of the invention in which an exclusive property or privilege is claimed are defined as follows:

1. A multi-story exterior atria building comprising:

a multi-story habitable space which in horizontal section includes at each story, a central area, and three radially extending spokes surrounding said central area and symmetrically extending outwardly from said central area, each of said radially extending spokes being habitable and having, an outer end wall, and a pair of side walls extending in a generally radial direction and each of said side walls having at least one transparent portion;

the inner ends of adjacent side walls of each successive pair of spokes being joined to form in horizontal section a shallow U;

a transparent circumferential wall extending between each pair of joined side walls at the outer ends thereof throughout the height of said multi-story building to define thereby an exterior atrium such that three exterior atria extend about said multi-story building; and the walls of the shallow U's being so constructed and oriented in relation to one another as to provide from within the habitable space, through any one of the transparent portions of said side walls, a view of substantially the whole area of the adjoining atrium and a broad view of the outdoors through the transparent circumferential wall while providing only an oblique view of other portions of the same U thereby substantially minimizing the visual exposure thereof.

2. A building structure as claimed in claim 1 wherein one of the circumferential walls extends between the outer ends of the pair of joined side walls forming each shallow U thereby to form together with the end walls of the spokes a substantially circular exterior enclosure.

3. A building structure as claimed in claim 1 wherein a plurality of dwelling units adjoin each of the shallow U's each dwelling unit having a transparent area providing a view of the associated atrium and of the outdoors.

4. A building structure as claimed in claim 1, 2 or 3 wherein each of the side walls of the spokes comprises a facade having a balcony and a decorative screening means.

* * * * *